US011883753B2

(12) United States Patent
Aluisetti et al.

(10) Patent No.: US 11,883,753 B2
(45) Date of Patent: Jan. 30, 2024

(54) RANDOM SELECTION DEVICE

(71) Applicants: Marco Aluisetti, Locarno (CH); Marius Ciorica, Minusio (CH)

(72) Inventors: Marco Aluisetti, Locarno (CH); Marius Ciorica, Minusio (CH)

( * ) Notice: Subject to any disclaimer, the term of this patent is extended or adjusted under 35 U.S.C. 154(b) by 111 days.

(21) Appl. No.: 17/280,875

(22) PCT Filed: Sep. 19, 2019

(86) PCT No.: PCT/IB2019/057891
§ 371 (c)(1),
(2) Date: Mar. 27, 2021

(87) PCT Pub. No.: WO2020/065458
PCT Pub. Date: Apr. 2, 2020

(65) Prior Publication Data

US 2022/0001269 A1 Jan. 6, 2022

(30) Foreign Application Priority Data

Sep. 27, 2018 (CH) ..... 01177/18
Sep. 27, 2018 (IT) ..... 102018000008954

(51) Int. Cl.
*A63F 9/04* (2006.01)

(52) U.S. Cl.
CPC .... *A63F 9/0413* (2013.01); *A63F 2009/0493* (2013.01)

(58) Field of Classification Search
CPC ..... A63F 9/0413; A63F 2009/0493; A63F 9/0415; A63F 9/0468
See application file for complete search history.

(56) References Cited

U.S. PATENT DOCUMENTS 1,593,907 A 7/1926 Madan
2,526,123 A 10/1950 Dawson
(Continued)

FOREIGN PATENT DOCUMENTS

DE 801 077 C 12/1950
DE 801077 * 12/1950
DE 10 2008 044201 A1 6/2010

*Primary Examiner* — Michael D Dennis
(74) *Attorney, Agent, or Firm* — Jason Lee DeFrancesco

(57) ABSTRACT

The present invention relates to a device (1; 2) for randomly selecting a symbol among a plurality of pre-determined symbols, comprising a main body (11; 21) having a polyhedral shape provided with a plurality of sides (111) in even number parallel and in pairs parallel and opposite to each other, a plurality of containment compartments (12; 22) equal to the number of sides (111), provided with a transparent cover (121) at the side (111) and a support base (122), opposite the transparent cover (121) within the main body (11; 21), and a plurality of secondary devices (13) for randomly selection, each arranged within one of the containment compartments (12; 22) and comprising a secondary body having a polyhedral shape provided with a plurality of sides (131) in even number parallel and in pairs opposite to each other, wherein each face (131) of the secondary devices for randomly selection is able to be placed onto the support base (122) by arranging only one face (131), corresponding to the face (131) parallel and opposite to the support base (122). parallel to the support base (122) and at the transparent cover (121).

7 Claims, 4 Drawing Sheets

(56) References Cited

U.S. PATENT DOCUMENTS

| | | | | |
|---|---|---|---|---|
| 5,261,666 | A * | 11/1993 | Chen | A63F 11/0011 273/146 |
| 10,112,106 | B1 * | 10/2018 | Riegel | A63B 67/06 |
| 2008/0272542 | A1 * | 11/2008 | Norman | A63F 9/0415 273/146 |

* cited by examiner

RANDOM SELECTION DEVICE

FIELD OF THE INVENTION

The present invention relates to a random selection device for selecting a symbol from a plurality of pre-determined symbols. Specifically, the present invention relates to a device for randomly selection made in such a way as to allow the use of a large number of pre-determined symbols from which the selection is to be made, although a small-sized device is used.

In the following description, reference will be made, for the sake of brevity, to a gaming die, but what has been described may be applied to any type of device that may be applied to manual randomization of symbols, numbers, letters, etc.

BACKGROUND ART

In the prior art, there are different types of devices for randomly selecting symbols, specifically devices for randomly selecting numbers. Such devices may be made for the manual or automated random selection, e.g. by means of a built-in electronic circuit or a connection to a computing system, of numbers for professional or entertaining applications.

In the devices for randomly selection of the manual type, among which dice, i.e. solid devices with a typically cubic shape, can be mentioned, each symbol of a pre-determined set of symbols from which the random selection is to be made is arranged on a face or side. The random selection of the symbol is carried out by rolling or throwing the die on a plane, or flat surface, so as to place only one side parallel to the plane opposing to the plane resting on it. It follows that the number of pre-determined symbols from which the selection is to be made is limited to the number of faces or sides of the same die, since it is able to expose a single symbol on each face, i.e. six symbols.

To increase the number of symbols from which the selection is to be made, devices for randomly selection have been developed with a polyhedral shape other than the cubic one and, specifically, with a number of opposing faces greater than six, such as the octahedron, provided with eight faces having an equilateral triangular shape, the dodecahedron, provided with twelve faces having an equilateral pentagonal shape, or the icosahedron, provided with twenty faces having an equilateral triangular shape.

It is apparent that by increasing the number of faces with which the basic solid forming the device for randomly selection is provided, it is possible to obtain a proportional increase in the number of pre-determined symbols from which the selection is to be made.

However, a problem related to the aforementioned solutions is that increasing the number of faces of the solid results in an increase in the size in terms of volume of the device itself so that the display size of the symbol may be kept constant on each face. As a result, an increase in the size results in a greater volume of material, followed by an increase in weight, leading to a more likely diversion of the selection randomness in the higher density portions of the volume. Likewise, the greater number of faces to be provided results in a significant increase in the complexity and production cost of the device itself.

Furthermore, the arrangement of each symbol on one of the faces of the solid means that a new device has to be designed and manufactured each time one decides to increase or decrease the number of pre-determined symbols from which the selection is to be made. Likewise, re-designing and re-manufacturing the device is necessary even when the pre-determined set of symbols is modified, while keeping its number unchanged.

Document DE102008044201 describes a gaming die in which the arrangement of identification marks is variable, not defined by a fixed layout model. In particular, the identification signs are formed by mobile bodies and electrically switchable display units, for example light-emitting diodes, in which only the identification sign corresponding to that to be displayed is selected with respect to the possibility of possible identification marks.

It would therefore be desirable to have a device for randomly selection capable of minimizing the drawbacks described above. Specifically, it would be desirable to have a device for randomly selection capable of increasing the number of the pre-determined set of symbols from which the selection is to be made without requiring a proportional increase in the number of faces of the device itself.

SUMMARY OF THE INVENTION

The object of the present invention is to provide a device for randomly selection capable of minimizing the aforementioned drawbacks.

Another object of the present invention is to provide a device for randomly selection capable of managing a number of the pre-determined set of symbols from which the extraction higher than the number of faces of the solid forming it is to be performed.

Finally, an object of the present invention is to provide a device for randomly selection capable of adapting to a plurality of pre-determined sets of symbols from which the extraction is to be performed, both in terms of number and in terms of type.

The aforementioned objects are achieved by a device for randomly selecting a symbol among a plurality of pre-determined symbols, in accordance with the appended claims.

The device for randomly selection comprises a main body having a polyhedral shape provided with a plurality of even-numbered parallel and opposite paired sides, wherein each of the sides is able to be placed on a plane by placing the corresponding parallel and opposite side in a position parallel to, and spaced from, the plane;

the device for randomly selection comprises a plurality of containment compartments equal to the number of sides, wherein each containment compartment is made at one of the sides within the main body and is provided with a transparent cover at the side and a support base, opposite the transparent cover within the main body, wherein the device for randomly selection further comprises a plurality of secondary devices for randomly selection, each arranged within one of the containment compartments and comprising a secondary body having a polyhedral shape provided with a plurality of even-numbered parallel and opposite paired faces, wherein each face is provided with one of the pre-determined graphic symbols, wherein each of the secondary devices for randomly selection has such a size as to be moved within the containment compartment, and wherein each of the faces of the secondary device for randomly selection is able to be placed onto the support base by arranging only one face, corresponding to the face parallel and opposite to the support base, parallel to the support base and at the transparent cover.

This way, it is possible to use a device having a polyhedral configuration with a pre-specified number of faces for the random selection of a symbol from a set wider than the number of faces and, specifically, equal to more of the sum of the faces of each secondary device for randomly selection contained in the aforementioned device for randomly selection.

The support base is parallel to the side on which the respective containment compartment is made.

This allows to always get only one parallel face during the selection and, as a result, a single symbol to select.

The containment compartment has a truncated cone shape with the larger base arranged at the side of the main body and the smaller base consisting of the support base.

This way, it is possible to significantly improve the movement of the secondary device for randomly selection within the containment compartment itself, thus obtaining a selection of the actual random type.

The shape and size of the support base are substantially equal to the shape and size of the faces of the secondary device for randomly selection contained in the corresponding containment compartment.

This allows an optimal arrangement of the face of the secondary device for randomly selection on the respective support base, thus obtaining a selection of the actual random type.

The main body and the secondary body have the same polyhedral shape. Preferably, the main body has a substantially cubic shape. Even more preferably, the secondary body has a substantially cubic shape.

The main body and the said containment compartments are made up of separate elements, wherein the main body is defined by an outer frame which has a through opening at each of the sides, and wherein the containment compartments are coupled within the frame so as to close the through opening at each of the sides.

Preferably, the main body has a cubic shape formed by two portions which are equal and coupled one to another.

The device is therefore made to be substantially oriented to the high capacity of modifying the containment compartments and/or secondary devices for randomly selection in such a way as to allow significant variations in the number of pre-determined sets of symbols from which the extraction is to be performed.

Alternatively, the main body and the containment compartments are made from a single element.

This way, the device for randomly selection can be made allowing the maximum simplification of production, at the expense of the geometrical modification of the containment compartment.

DESCRIPTION OF THE FIGURES

These and further features and advantages of the present invention will become apparent from the disclosure of preferred embodiments, illustrated by way of non-limiting example in the appended drawings, wherein.

DETAILED DESCRIPTION OF THE INVENTION

Figure 1:
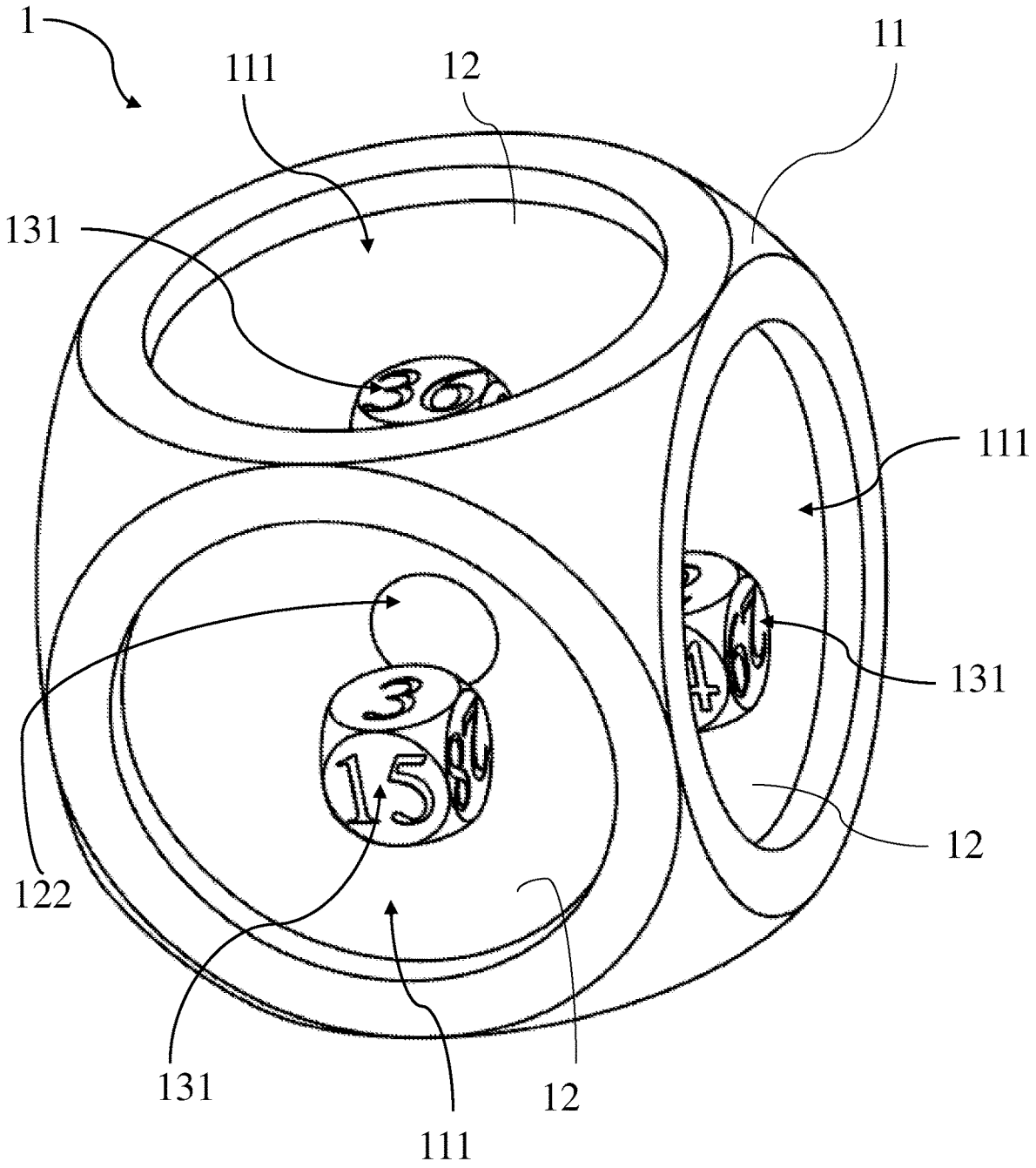
FIG. 1 is a perspective view of a first embodiment of the device for randomly selection, according to the present invention.
Figure 2:
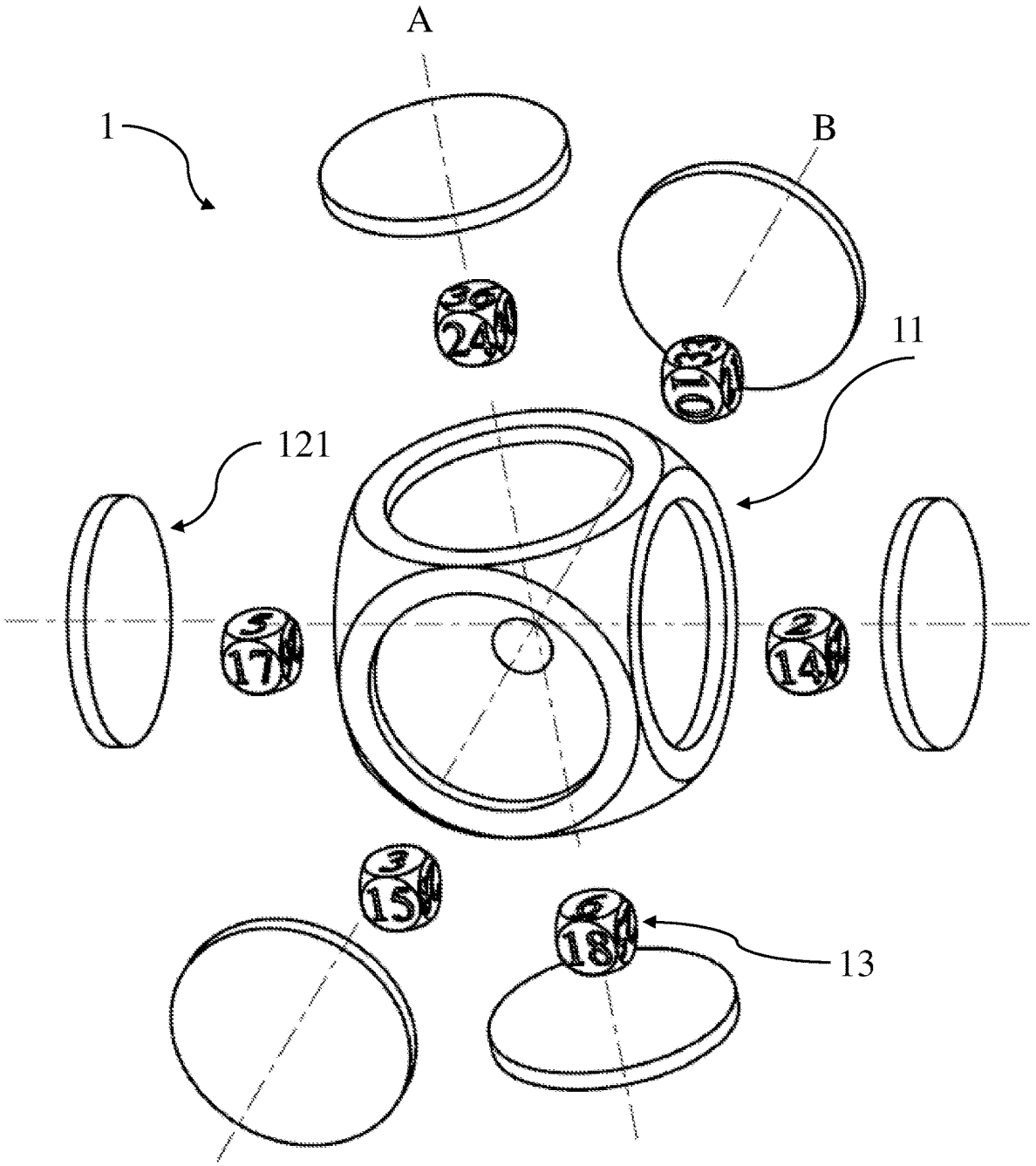
FIG. 2 is a perspective view in an exploded configuration of the device for randomly selection in FIG. 1.

With reference to FIGS. 1 and 2, a first embodiment of the device for randomly selecting a symbol among a plurality of pre-determined symbols, according to the present invention, is illustrated. Specifically, the same numerals will be maintained in the following for like elements, but relating to different embodiments.

The term "symbol" means, in the present invention, any graphic sign, such as a character, a number applied on the face of the secondary device for randomly selection, as described below. Likewise, it is possible to refer the term "symbol", according to the present invention, also to the application of a colour on the same face without using any graphic sign.

In the following description, reference will be made, for the sake of brevity, to a gaming die, but what has been described may be applied to any type of device for randomly selection, both for professional applications and for entertaining applications.

In the embodiment illustrated in FIGS. 1 and 2, the device 1 for randomly selection comprises a main body 11 having a polyhedral shape, specifically having a substantially cubic shape. The main body could also have a different polyhedral shape, such as an octahedral, dodecahedral, or icosahedral one.

Specifically, the main body 11 has a plurality of sides 111 which, in the cubic shape embodiment illustrated in FIG. 1, comprises 6 sides in total. However, the total of the sides of the main body is the same as the aforementioned parallel and opposite paired sides. Therefore, as described in greater detail below, when the device 1 for randomly selection is arranged with one of the sides 111 on the plane, the corresponding parallel and opposite side is arranged in a position parallel to, and spaced from, the aforementioned plane (not shown).

The device 1 for randomly selection also has a plurality of containment compartments 12 equal to the number of said sides 111, i.e. six compartments for the aforementioned cubic embodiment. Each containment compartment 12 is made at one of the sides 111, each side 111 being, in the present embodiment, an integral part of the containment compartment 12 and defining one of the walls thereof. Thus, in the embodiment shown in FIGS. 1 and 2, the main body 11 and the aforementioned containment compartments 12 are made up of a single element. This construction can be obtained, for example, by shaping by stock removal, such as to provide the necessary containment compartments by removing the necessary material starting from each side of the main body 11. Furthermore, it is possible to obtain the same construction by additive manufacturing starting from a digital three-dimensional model.

Each containment compartment 12 is provided with a cover 121 arranged at the side 111 and basically forming the side 111 itself. Actually, the cover 121 is arranged on a plane other than the edge of the side 111, in such a way that, when placed on the plane the side 111, it contacts the same plane only with the edge and not with the cover 121.

Likewise, according to different embodiments, not shown, the cover could form the outermost surface of the side, i.e. the surface in contact with the possible support plane.

In the embodiment shown in FIGS. 1 and 2, the containment compartment 12 has a truncated cone shape with the larger base arranged at the side 111 of the main body 11 and the smaller base consisting of the support base 122. In this case, the support base 122 is parallel to the side 111 on which the containment compartment 12 corresponding to the aforementioned support base is arranged.

The shape of the containment compartment can have, according to different embodiments, not shown, a shape other than the truncated cone one, but, in any case, such as to be contained within the useful volume of the main body of the device for randomly selection. Specifically, the shape of the containment compartment must in any case be such as to ensure the accommodation and movement therein of a secondary device for randomly selection, as described in detail below.

The containment compartments 12 are made within the main body 11, thus arranging the six containment compartments 12 within the useful volume defined by the cubic shape of the main body 11. Each containment compartment 12 is able to house a further secondary device 13 for randomly selection, having such a size as to be able to be housed and moved within the aforementioned containment compartment 12. Specifically, the above-described shape of the containment compartment 12 is such as to have a volume greater than the volume of the secondary device 13 for randomly selection which it has to contain, and, as a result, a height of the truncated cone geometry greater than the maximum size of the secondary device 13 for randomly selection.

To obtain the desired function by the containment compartment 12, each of them is provided with a cover 121 made of a transparent material, thereby allowing to check the corresponding containment compartment 12, as well as the secondary device 13 for randomly selection arranged therein.

Considering the number of the containment compartments 12 relating to the cubic shape of the main body 11, the device 1 for randomly selection therefore comprises six secondary devices 13 for randomly selection. Each of the secondary devices 13 for randomly selection comprises a secondary body having a polyhedral shape provided with a plurality of even-numbered parallel and opposite paired faces 131, wherein each face 131 is provided with one of the pre-determined graphic symbols from which the random selection is to be made.

In the embodiment described herein and illustrated in FIGS. 1 and 2, the main body 11 of the device 1 for randomly selection and the secondary body of the secondary device 13 for randomly selection have the same polyhedral shape, specifically the same cubic shape, albeit with different scale sizes. Furthermore, each secondary device 13 for randomly selection has the same shape and size as the remaining secondary devices 13 for randomly selection. This way, it is easier to ensure uniformity of distribution and, therefore, randomness in the random selection of a symbol among the plurality of symbols available.

According to further embodiments, not shown, the secondary body of the secondary device for randomly selection can have a polyhedral shape other than that of the main body of the device for randomly selection. Likewise, the polyhedral shape of each secondary body can vary within each containment compartment.

As described above, each of the secondary devices 13 for randomly selection comprises a secondary body having a polyhedral shape provided with a plurality of even-numbered parallel and opposite paired faces 131, wherein each face 131 is provided with one of the pre-determined graphic symbols from which the random selection is to be made. Specifically, each of the aforementioned faces 131 is able to be placed on the said support base 122 so as to be able to identify one of the pre-determined graphic symbols impressed on the faces 131, as described in greater detail below.

The size of the containment compartment 12 and of the secondary devices 13 for randomly selection are, therefore, such as to allow the containment and movement of each secondary device 13 for randomly selection in the respective containment compartment 12. Specifically, in the truncated cone geometry defined in the embodiment of FIGS. 1 and 2, the height is greater than the diagonal of the cube defined by the secondary body of the secondary device 13 for randomly selection. Likewise, the shape and size of the support base 122 are substantially equal to the shape and size of the faces 131 of the secondary device 13 for randomly selection contained in the corresponding containment compartment 12.

The aforementioned sizing ensures, on the one hand, the proper possibility of moving the secondary device 13 for randomly selection and, on the other hand, the certainty of having a single side of the same secondary device 13 correctly in contact with the support base 122, i.e. a corresponding parallel and opposite side at the cover 121 of the side 111.

Nevertheless, it is possible to carry out a different dimensioning of the pair defined by the containment compartment and of the respective secondary device for randomly selection, such as to ensure anyway that the secondary device is contained and moved properly, and the proper positioning of a single side at the cover of the side of the device for randomly selection can be systematically achieved. For example, it is possible to define the support base in such a way that its shape and size differ from that of the sides of the secondary device for randomly selection, a greater size, i.e. a different geometrical shape such as to inscribe the geometry of the aforementioned side of the secondary device therein.

The use of the device 1 for randomly selection described above is briefly described below.

It is assumed that a user is able to hold the aforementioned device 1 for randomly selection in a hand and to throw it onto a plane large enough to allow it to roll.

The cubic shape of the device 1 for randomly selection will cause the rolling to be stochastically carried out with respect to all the sides thereof without following a specific rolling sequence, employing the vertices and edges of each side as a support point for rolling.

While rolling onto the plane, each secondary device 13 for randomly selection is able to be equally moved stochastically within the respective containment compartment 12.

At the end of the rolling, the device 1 for randomly selection will be arranged with one of the sides 111 of the main body 11 on the rolling plane in a static state. On the side parallel and opposite to the rolling plane, the side 111 of the body parallel and opposite to the one arranged on the rolling plane will therefore be arranged with the containment compartment 12 in view. Likewise, the secondary device 13 for randomly selection arranged within the aforementioned containment compartment 12 will be arranged in a static state, specifically by arranging only one face 131, corresponding to the face 131 parallel and opposite to the support base 122, parallel to the support base 122 and at the transparent cover 121.

This way, it will be possible to select a symbol among a plurality of randomly pre-determined symbols. That is, it is possible to identify the symbol affixed to the aforesaid face 131 corresponding to the face 131 parallel and opposite to the support base 122, among the plurality of symbols affixed on each side of the devices 13 for randomly selection.

Figure 3:
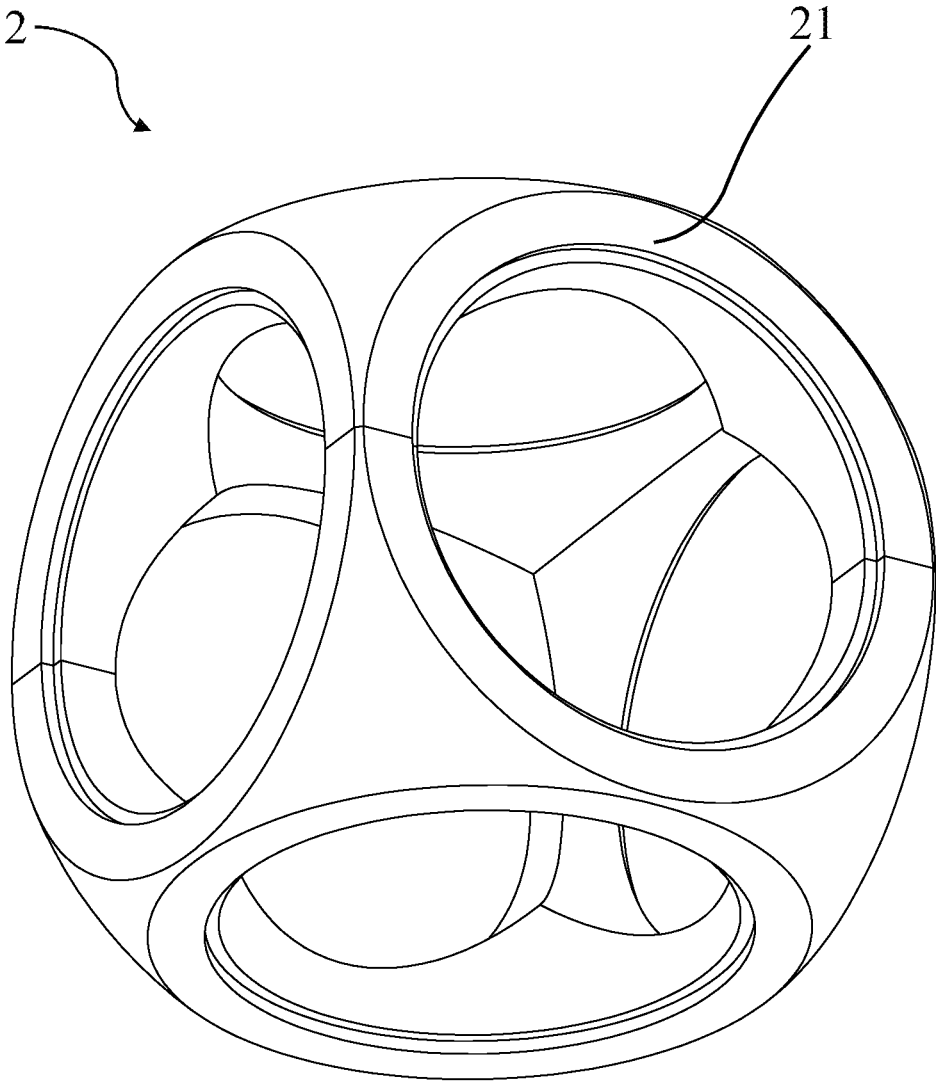
FIG. 3 is a schematic perspective view of a second embodiment of the device for randomly selection, according to the present invention.
Figure 4:
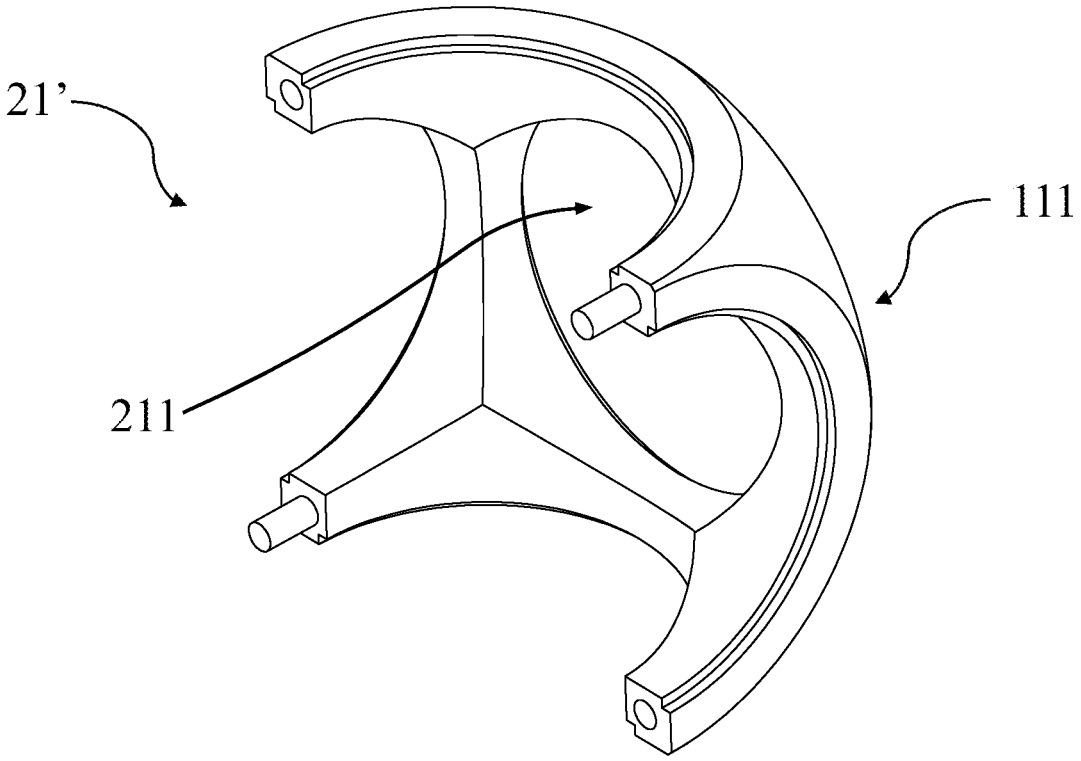
FIG. 4 is a perspective view of a portion of the main body of the device for randomly selection in FIG. 3.
Figure 5:
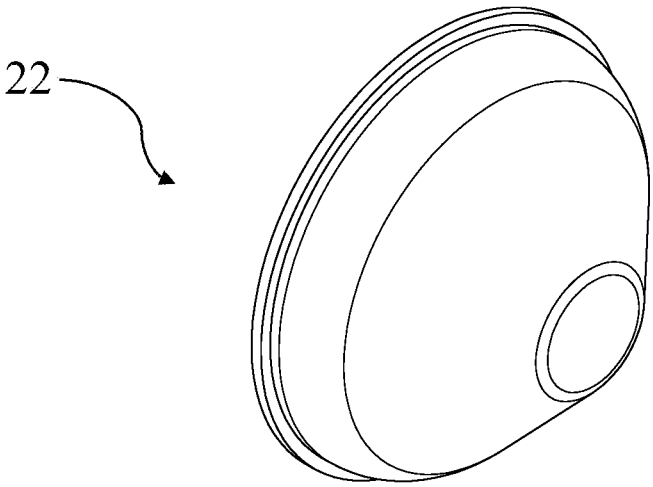
FIG. 5 is a perspective view of the containment compartment of the device for randomly selection in FIG. 3.

The second embodiment described herein and illustrated in FIGS. 3-5 has the same features described in the previous embodiment, which will not be described further, being referred to by reference, but a different structure for the components of the device 2 for randomly selection, i.e. of its main body 21 and of the respective containment compartments 22.

The device 2 for randomly selection comprises a main body 21 having a polyhedral shape, specifically having a substantially cubic shape. The device 2 for randomly selection further has a plurality of compartments 12, as described above.

Specifically, the main body 21 and the aforementioned containment compartments 22 are made up of separate elements, i.e. the main body 21 is defined by an outer frame which has a through opening 211 at each of said sides 111, while the containment compartments 22 are coupled within the frame so as to close the through openings 211 in each of the sides 111.

Moreover, to facilitate the construction of the device 2 for randomly selection and the proper installation of the containment compartments 22, the main body 21 has a cubic shape formed by two portions 21' which are equal and coupled one to another.

Likewise, according to different embodiments, it is possible to both embody the containment compartments by assembling multiple portions and define a different coupling structure for the main body.

Thus, in the embodiment illustrated in FIGS. 3-5, the main body 21 and the aforementioned containment compartments 22 are made up of separate elements, whose construction may be obtained, independently for each part, both by shaping by stock removal and by additive manufacturing starting from a digital three-dimensional model.

The invention claimed is:

1. A device for randomly selecting a symbol among a plurality of predetermined symbols, said device comprising:

a main body having a polyhedral shape provided with a plurality of sides in even number and in pairs parallel and opposite to each, wherein each side is able to be placed on a plane by placing the corresponding parallel and opposite side in a position parallel to, and spaced from, said plane;

a plurality of containment compartments equal to the number of said sides, wherein each containment compartment is made at one of said sides within said main body and is provided with a transparent cover at said side and a support base, opposite said transparent cover within said main body;

a plurality of secondary devices for randomly selecting a symbol, each arranged within one of said containment compartments, and characterized in that each secondary device comprises a secondary body having a polyhedral shape provided with a plurality of faces in even number and in pairs parallel and opposite to each, wherein each face is provided with a predetermined symbol, wherein each secondary device has such a size as to be freely moved within said containment compartment, and wherein each face of said secondary device is able to be placed onto said support base by arranging only one face, corresponding to said face parallel and opposite to said support base, parallel to said support base and at said transparent cover;

wherein said containment compartment has a truncated cone shape with the larger base arranged at the side of said main body and the smaller base consisting by said support base, and wherein the shape and size of said support base are substantially equal to the shape and size of said faces of said secondary device contained in said corresponding containment compartment; and, wherein said main body and the said containment compartments are made up of separate elements, wherein said main body is defined by an outer frame which has a through opening at each of said sides, and wherein the containment compartments are coupled within said frame so as to close said through opening at each of said sides.

2. The device according to claim 1, wherein said support base is parallel to said side on which said respective containment compartment is made.

3. The device according to claim 1, wherein said main body and said secondary body have the same polyhedral shape.

4. The device according to claim 1, wherein said main body has a substantially cubic shape.

5. The device according to claim 1, wherein said secondary body has a substantially cubic shape.

6. The device according to claim 1, wherein said main body has a cubic shape formed by two portions which are equal and coupled one to another.

7. A device for randomly selecting a symbol among a plurality of predetermined symbols, said device comprising: a main body having a cubic shape formed by two portions which are equal and coupled one to another and defined by an outer frame which has a through opening at each of said sides and having a polyhedral shape provided with a plurality of sides in even number and in pairs parallel and opposite to each, wherein each side is able to be placed on a plane by placing the corresponding parallel and opposite side in a position parallel to, and spaced from, said plane;

a plurality of containment compartments, equal to the number of said sides, are coupled within said outer frame so as to close said through opening at each of said sides, wherein each containment compartment is made at one of said sides within said main body and is provided with a transparent cover at said side and a support base, opposite said transparent cover within said main body, wherein said main body and the said containment compartments are made up of separate elements;

a plurality of secondary devices for randomly selecting a symbol, each arranged within one of said containment compartments, and characterized in that each secondary device comprises a secondary body having a polyhedral shape provided with a plurality of faces in even number and in pairs parallel and opposite to each, wherein each face is provided with a predetermined symbol, wherein each secondary device has such a size as to be moved within said containment compartment, and wherein each face of said secondary device is able to be placed onto said support base by arranging only one face, corresponding to said face parallel and opposite to said support base, parallel to said support base and at said transparent cover.

* * * * *